US009302305B2

(12) United States Patent
Kerscher

(10) Patent No.: US 9,302,305 B2
(45) Date of Patent: Apr. 5, 2016

(54) TOOL RETENTION DEVICES AND RELATED MACHINE TOOLS AND METHODS

(71) Applicant: TRUMPF Werkzeugmaschinen GmbH + Co. KG, Ditzingen (DE)

(72) Inventor: Stefan Kerscher, Walzbachtal (DE)

(73) Assignee: TRUMPF Werkzeugmaschinen GmbH + Co. KG, Ditzingen (DE)

( * ) Notice: Subject to any disclaimer, the term of this patent is extended or adjusted under 35 U.S.C. 154(b) by 0 days.

(21) Appl. No.: 13/667,677

(22) Filed: Nov. 2, 2012

(65) Prior Publication Data

US 2013/0055874 A1 Mar. 7, 2013

Related U.S. Application Data

(63) Continuation of application No. PCT/EP2011/056081, filed on Apr. 18, 2011.

(30) Foreign Application Priority Data

May 6, 2010 (DE) ..... 10 2010 028 678

(51) Int. Cl.
*B21D 28/34* (2006.01)
*B21D 5/02* (2006.01)

(52) U.S. Cl.
CPC ..... *B21D 5/0209* (2013.01); *B21D 28/34* (2013.01); *Y10T 29/49826* (2015.01); *Y10T 83/9476* (2015.04); *Y10T 279/29* (2015.01)

(58) Field of Classification Search
CPC .... B21D 28/34; B21D 28/343; B21D 28/346; B21D 28/246; B21D 5/0209; B26F 2001/4454; Y10T 279/29
USPC ..... 83/613, 627, 639.1, 140, 698.91, 83/698.71, 686
See application file for complete search history.

(56) References Cited

U.S. PATENT DOCUMENTS

| | | | | |
|---|---|---|---|---|
| 4,577,875 | A | 3/1986 | Miyakawa | |
| 7,658,134 | B2 * | 2/2010 | Morgan | 83/530 |
| 7,784,317 | B2 | 8/2010 | Denkmeier et al. | |
| 2003/0024367 | A1 * | 2/2003 | Morehead et al. | 83/686 |
| 2010/0107832 | A1 * | 5/2010 | Johnston et al. | 83/13 |

FOREIGN PATENT DOCUMENTS

| | | | |
|---|---|---|---|
| EP | 1338354 | A1 | 8/2003 |
| EP | 1741501 | A2 | 1/2007 |
| JP | 2010064244 | A | 3/2010 |

OTHER PUBLICATIONS

International Search Report from corresponding PCT Application No. PCT/EP2011/056081, mailed Aug. 30, 2011, 4 pages.
Notification of Transmittal of Translation of the International Preliminary Report on Patentability from corresponding PCT Application No. PCT/EP2011/056081, mailed Nov. 15, 2012, 7 pages.

* cited by examiner

*Primary Examiner* — Kenneth E. Peterson
*Assistant Examiner* — Jennifer Swinney
(74) *Attorney, Agent, or Firm* — Fish & Richardson P.C.

(57) ABSTRACT

A tool retention device of a machine tool includes a tool receiving member, at least one tool abutment, an axial tensioning device, and a radial clamping device. The tool receiving member serves to at least partially receive a processing tool. At least one axial tensioning element of the axial tensioning device pulls the processing tool against an associated tool abutment along a direction of a tensioning axis. While the radial clamping device is decoupled therefrom, the radial clamping device clamps the processing tool by at least one radial clamping element in a direction perpendicular to the tensioning axis of the axial tensioning device. A machine tool may also be provided with the tool retention device.

11 Claims, 4 Drawing Sheets

TOOL RETENTION DEVICES AND RELATED MACHINE TOOLS AND METHODS

CROSS REFERENCE TO RELATED APPLICATIONS

This application is a continuation of and claims priority under 35 U.S.C. §120 to PCT Application No. PCT/EP2011/056081 filed Apr. 18, 2011, which claimed priority to German Application No. 10 2010 028 678.8 filed on May 6, 2010. The contents of both of these priority applications are hereby incorporated by reference in their entirety.

TECHNICAL FIELD

This disclosure relates to tool retention devices and related machine tools and methods.

BACKGROUND

Punching presses include punching heads to which punching tools are able to be mounted and dismounted. Punching tools that are constructed as punching dies have a cylindrical tool shaft and a plate-like adjustment ring that extends in a radial direction of the tool shaft. In order to receive the tool shaft, a tool receiving member is provided on the punching head. When a punching die is mounted, the punching head and the relevant punching tool are positioned relative to each other in such a manner that the tool shaft of the punching die comes to rest inside of the tool receiving member of the punching head. In such an instance, the tool shaft of the punching die moves between the collet members of a collet chuck located inside of the punching head. Such a configuration is part of an axial tensioning device and is fitted as such to a piston rod of a piston/cylinder unit of the axial tensioning device.

The piston rod of the piston/cylinder unit is coaxial with the tool shaft of the punching die. If the piston rod is pulled back in an axial direction by appropriate application of a pressure to the piston/cylinder unit, the collet chuck fitted to the piston rod closes, and the collet members of the collet chuck acting as axial tensioning elements engage with the free ends thereof behind a shaft step that is formed on the tool shaft of the punching die. With continued retracting movement of the piston rod, the tool shaft of the punching die is drawn by the collet chuck towards the interior of the tool receiving member until the adjustment ring that protrudes laterally over the tool shaft of the punching die moves into abutment with the edge of the tool receiving member, and the punching die is ultimately pulled by the adjustment ring against the edge of the tool receiving member in an axial direction of the tool shaft.

SUMMARY

The present disclosure describes systems and methods for improving the fixing of processing tools to tool retention devices of machine tools.

In one aspect of the invention, a tool retention device for a machine tool includes a tool receiving member for at least partially receiving a processing tool of the machine tool, at least one tool abutment, an axial tensioning device having an axial tensioning element that is controllably transferable to a clamping state, the processing tool being securable to the tool receiving member by the axial tensioning element when the processing tool has been received in the tool receiving member and the axial tensioning element has been transferred to the tensioning state, wherein the processing tool is pulled against an associated tool abutment along a direction of a clamping axis of the axial tensioning device, and a radial clamping device having at least one radial clamping element that is controllably transferable to a clamping state while decoupled from the axial tensioning element of the axial tensioning device. The processing tool that is securable to the tool receiving member by the radial clamping element when the processing tool has been received in the tool receiving member and the radial clamping element that has been transferred to the clamping state, wherein the processing tool that is pulled against the associated tool abutment is clamped along the direction perpendicular to the tensioning axis of the axial tensioning device.

In some embodiments, the radial clamping device has at least one radial clamping element that can be actuated independently of the axial tensioning device. Using the at least one radial clamping element, the processing tool can be clamped on the associated tool abutment of the tool retention member in a direction perpendicular to the tensioning axis of the axial tensioning device, in addition to being tensioned by the axial tensioning device. Due to the decoupling of the at least one radial clamping element from the axial tensioning device, it is possible to first fix a processing tool that is intended to be secured to the tool retention device to the tool retention device using the axial tensioning device and subsequently to further fix the processing tool using the radial clamping element(s) which is/are actuated independently of the axial tensioning device. The cooperation of the axial tensioning device and the radial clamping device results in dual-axis securing of the processing tool, which is effective in that almost any relative movement of the processing tool and tool retention device is prevented, even in the case of moving processing-related loads. The wear that occurs during operation at the interface of the processing tool and tool retention device is consequently reduced or minimized. Exceptionally long service lives of the tool retention device and a durable configuration of the processing tool on the tool retention device are thereby ensured.

In some embodiments, the axial tensioning and radial clamping elements that can be actuated in a manner decoupled from each other can be transferred into a rest state, a state of operational readiness, and a tensioning or a clamping state. During a tool changing operation (e.g., when a tool is to be transferred toward or away from the tool receiving member), the tensioning and clamping elements are in the rest state. In order to transfer the tensioning and clamping elements, which can be actuated in a manner decoupled from each other, from the rest state into the state of operational readiness, a common adjusting device of the axial tensioning device and the radial clamping device is used. Using such a device results in a structurally simple and compact arrangement of the system.

The axial tensioning and radial clamping elements can be actuated to transfer the elements from the state of operational readiness to the tensioning or the clamping state.

In some embodiments, the common adjusting device is a common positioning device that includes a positioning drive via which the axial tensioning element(s) and the radial clamping element(s) can be moved together and independently from one another from the rest position into the position of operational readiness.

In certain embodiments, the tensioning and clamping elements are both disposed on an element carrier of the common positioning device during movement of the tensioning and clamping elements from the rest position into the position of operational readiness. The element carrier is driven by the positioning drive of the common positioning device of the axial tensioning device and the radial clamping device.

In some embodiments, the element carrier of the common positioning device, which supports the tensioning and clamping elements, is formed directly by a drive element of the positioning drive of the common positioning device. The number of components that form the tool retention device is thereby reduced or minimized as a result of the multifunctional nature of the element carrier. In this manner, the tool retention device is provided in a structurally simple and a space-saving configuration.

In certain embodiments, a controlled axial tensioning drive serves to move the axial tensioning element(s) from the position of operational readiness into the tensioning position, which is associated with the tensioning state of the axial tensioning element(s). Accordingly, a radial clamping drive is provided for moving the radial clamping element(s) from the position of operational readiness into the clamping position. Either the axial tensioning drive or the radial clamping drive uses the element carrier of the common positioning device of the axial tensioning device and radial clamping device in order to drive the respective tensioning and clamping element(s) into the tensioning or clamping position.

In some embodiments, the tensioning and clamping elements are decoupled from the element carrier prior to moving the tensioning and clamping elements from the position of operational readiness into the clamping position.

In some embodiments, either or both of the axial tensioning drive and the radial clamping drive include a wedge gear having a drive motor-side wedge gear element and a tensioning element-side or a clamping element-side wedge gear element. Wedge gears of this type are extraordinarily reliable during operation. In addition to a compact structure, such gears can also transmit large drive forces and/or redirect the effective direction of drive forces. A gear transmission ratio can be adjusted in a simple manner by selecting appropriate corresponding wedge angles.

In certain embodiments, the element carrier of the common positioning device of the axial tensioning device and the radial clamping device is provided as a drive motor-side wedge gear element of the axial tensioning drive and/or the radial clamping drive. The element carrier of the common positioning device accordingly performs an additional function.

Other aspects, features, and advantages will be apparent from the description, the drawings, and the claims.

DETAILED DESCRIPTION

Figure 1:
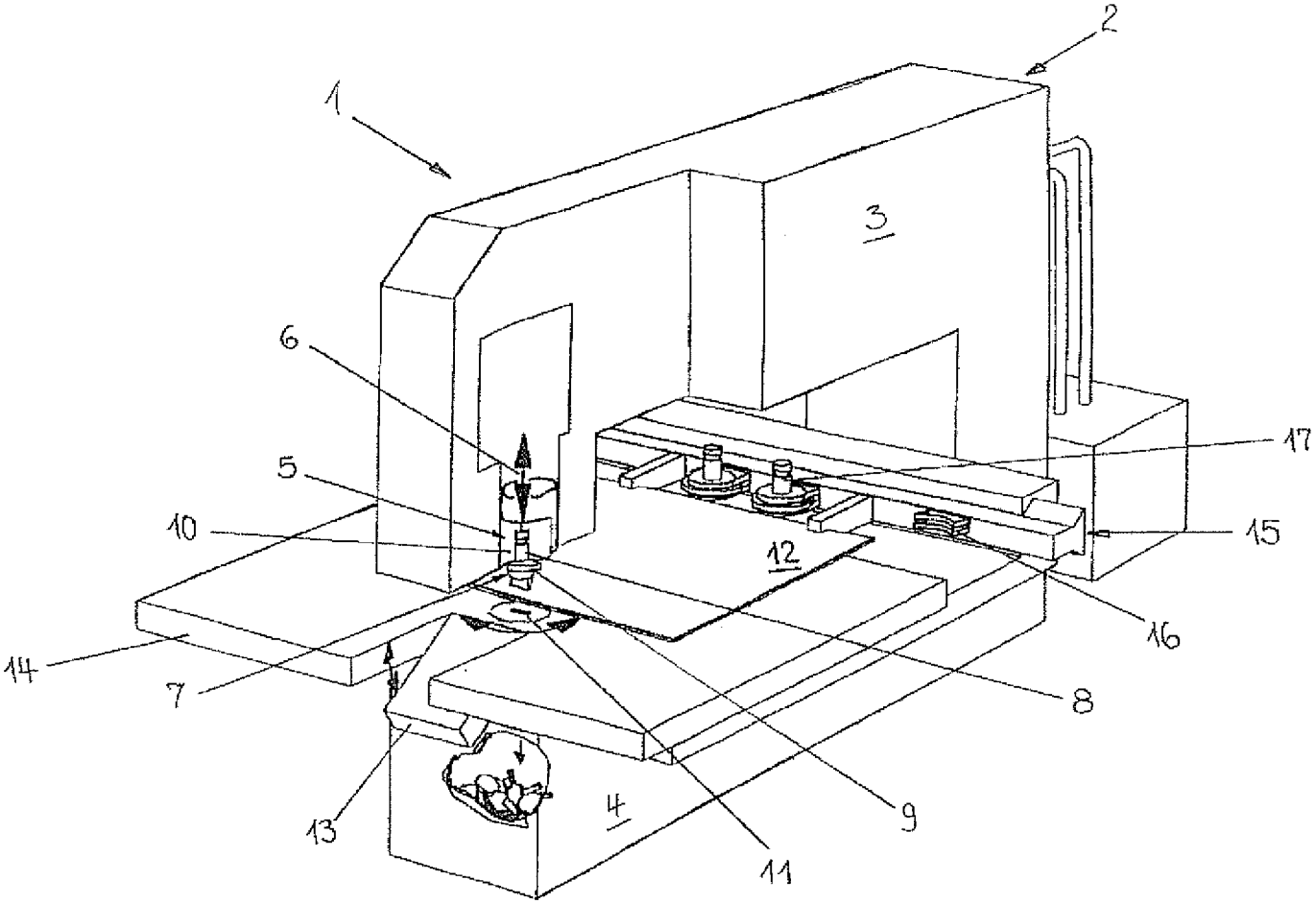
FIG. 1 shows a punching machine that has a punching head including a ram.

FIG. 1 shows a machine tool that is constructed as a punching machine 1. The punching machine 1 includes a C-shaped machine frame 2 that has an upper frame leg 3 and a lower frame leg 4. A punching head is located at the free end of the upper frame leg 3 and includes a ram 5 that can be raised and lowered by a numerically controlled punching drive in a stroke direction 6 (indicated by a double-headed arrow in FIG. 1).

The ram 5 is a tool retention device for a processing (e.g., punching) tool (e.g., a punch 7). The punch 7 includes a tool shaft 8 and an adjustment ring 9 that extends in a radial direction with respect to the tool shaft 8. The tool shaft 8 of the punch 7 is secured to a tool receiving member 10 of the ram 5. The adjustment ring 9 of the punch 7 is located external to the tool receiving member 10. The adjustment ring 9 abuts the lower end face of the ram 5, thereby providing a tool abutment.

A punching die 11 is located at the free end of the lower frame leg 4 of the punching machine 1 and underneath the punch 7. The punching die 11 cooperates with the punch 7 in a conventional manner in order to process a metal sheet 12. Punching waste is collected below the punching die 11 inside of the lower frame leg 4. Finished parts are discharged from an operating region of the punching machine 1 via a flap 13 that is integrated with a workpiece table 14.

Still referring to FIG. 1, a conventional coordinate guide 15 is located within a free space between the upper frame leg 3 and the lower frame leg 4 of the punching machine 1. In a conventional manner, the coordinate guide 15 can perform multiple functions. For example, the coordinate guide 15 can be used to position the metal sheet 12 in a desired horizontal plane with respect to the punch 7 and the punching die 11 so that the metal sheet 12 can be appropriately processed. Additionally, the coordinate guide 15 can be used as a tool magazine and can be used to perform tool changing operations.

When the punch 7 is secured to the ram 5 and is intended to be replaced by another punching tool, the coordinate guide 15, along with an empty tool holder 16 carried by the coordinate guide 15, moves toward the ram 5. The punch 7 that is secured to the ram 5 is then secured to the empty tool holder 16 and subsequently removed from the tool receiving member 10 of the ram 5 by moving the coordinate guide 15 laterally away from the tool receiving member 10. Subsequently, the coordinate guide 15 is moved laterally until another punch 17 that is secured to the coordinate guide 15 is introduced into the tool receiving member 10 of the ram 5.

FIGS. 2-5 show operational states of the ram 5 while the punch 7 is secured to the ram 5.

A tool tensioning and clamping device 18 is located inside of the ram 5. The tool tensioning and clamping device 18 includes an axial tensioning device 19 that has an axial tensioning drive 20 (shown in FIG. 4) and a radial clamping device 21 that has a radial clamping drive 22 (shown in FIG. 5).

Figure 7:
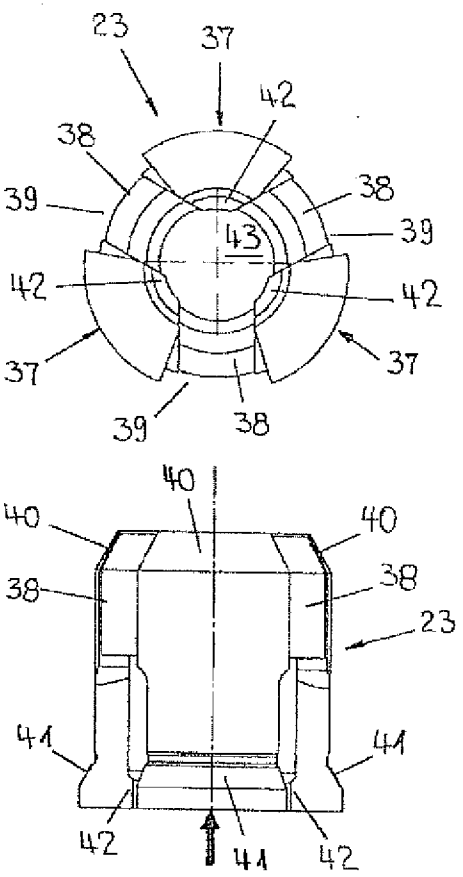
FIG. 7 shows a bottom view (top) and a side view (bottom) of the axial collet chuck of FIGS. 2-5.

The axial tensioning drive 20 serves to actuate an axial tensioning unit (e.g., an axial collet chuck 23, as shown in the example of FIG. 7). The axial tensioning drive 20 includes a connection rod 24 whose longitudinal axis coincides with a tensioning axis 25 of the axial tensioning device 19.

The radial clamping drive 22 includes a drive piston 26 that is guided along the tensioning axis 25 inside of the ram 5. The drive piston 26 serves to actuate a radial clamping unit (e.g., a radial collet chuck 27, as shown in the example of FIG. 6).

Figure 6:
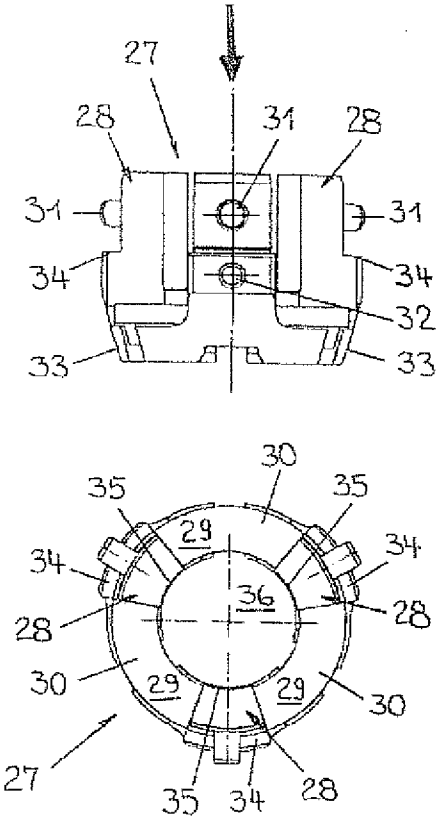
FIG. 6 shows a side view (top) and a top view (bottom) of the radial collet chuck of FIGS. 2-5.

FIG. 6 shows a side view (top) and a top view (bottom) of the radial collet chuck 27. The radial collet chuck 27 has three radial clamping elements in the form of collet members 28. The collet members 28 are made of hardened tool steel and are connected to each other at one end by resilient annular segments 29 that are made of rubber. The collet members 28 are spaced apart from each other along the circumference of the radial collet chuck 27, forming gaps 30 between consecutive collet members 28. Each of the collet members 28 includes a catch pin 31. One of the collet members 28 additionally includes a guide pin 32.

The collet members 28 are generally conical in shape and form wedge faces 33. Each collet member 28 includes a step face 34 that is located above a respective wedge face 33. The collet members 28 form pressure faces 35 that are located about a cylindrical receiving opening 36 of the radial collet chuck 27.

FIG. 7 shows a side view (bottom) and a bottom view (top) of the axial collet chuck 23. The axial collet chuck 23 has a bell-like shape and includes three axial tensioning elements that are constructed as collet members 37. The collet members 37 are connected to each by resilient annular segments 38 that are made of rubber. Adjacent the annular segments 38, gaps 39 are located between the collet members 37. The gaps 39 have a width that slightly exceeds the width of the collet members 28 of the radial collet chuck 27. The collet members 37 are made of hardened tool steel.

At their upper ends, the collet members 37 have a generally conical shape and form upper wedge faces 40. The collet members 37 further form lower wedge faces 41 located at the opposite longitudinal end of the collet members 37. Hooks 42 protrude radially inward from the surface of the collet members 37 that is opposite the lower wedge faces 41. The hooks 42 are located along a circumference of a passage 43 that extends through the axial collet chuck 23.

Referring again to FIGS. 2 and 3, during assembly, the connection rod 24 of the axial tensioning drive 20 is first fitted together with an associated connection rod drive located inside of a receiving hole of the ram 5. The connection rod 24 and the connection rod drive can be provided in various forms. For example, the connection rod 24 may be provided as a piston rod of a pneumatic or hydraulic piston/cylinder unit. In some cases, a spindle drive may be used to move the connection rod 24 along the tensioning axis 25.

The drive piston 26 of the radial clamping drive 22 is secured to (e.g., pushed onto) the free end of the connection rod 24. The drive piston 26 is sealed both with respect to the connection rod 24 and with respect to the wall of the receiving hole on the ram 5. A cylindrical space 44 through which the connection rod 24 extends is located inside of the ram 5 and adjacent to the drive piston 26.

Once the drive piston 26 is assembled, the axial collet chuck 23 is introduced into the drive piston 26 from the open side of the ram 5 with the annular segments 38 forward. The axial collet chuck 23 is moved (e.g., pushed) onto the free end of the connection rod 24 until the axial collet chuck 23 abuts the drive piston 26. A retention screw 45 that has an outer collar 46 is then screwed into the lower longitudinal end of the connection rod 24. The outer collar 46 extends radially (with respect to the tensioning axis 25) beyond a passage that is located in the base of the axial collet chuck 23 and through which the connection rod 24 extends.

Figure 8:
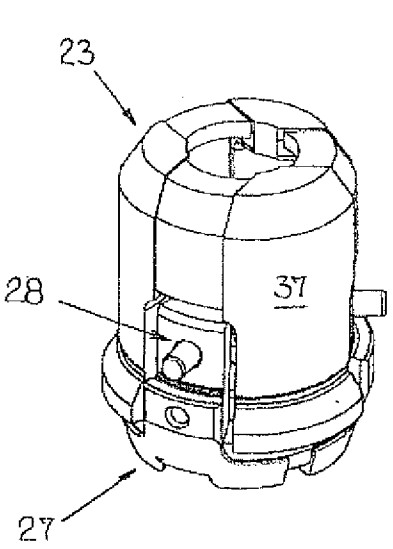
FIG. 8 shows a perspective view of a unit including the radial collet chuck of FIG. 6 and the axial collet chuck of FIG. 7.

After assembly of the axial collet chuck 23, the radial collet chuck 27 is moved (e.g., pushed) with the free ends of the collet members 28 forward into the lower end of the axial collet chuck 23. The radial collet chuck 27 and the axial collet chuck 23 are rotated with respect to each other through about 60° about the tensioning axis 25. Consequently, the collet members 28 of the radial collet chuck 27 are introduced into the gaps 39 between the collet members 37 of the axial collet chuck 23, thereby providing the configuration shown in FIG. 8. At this point, and as shown in FIG. 8, the guiding pin 32 of the radial collet chuck 27 has not yet been inserted into the corresponding hole (shown in FIG. 8).

Referring to FIGS. 2-5, once the radial collet chuck 27 is fitted onto the axial collet chuck 23 located inside of the drive piston 26, the collet members 28 of the radial collet chuck 27 are pivoted radially inwards using the resilience of the annular segments 29 of the radial collet chuck 27 to a position that allows the catch pins 31 on the collet members 28 of the radial collet chuck 27 to be introduced inside of the drive piston 26. Once the catch pins 31 of the radial collet chuck 27 reach the level of respective radial holes 47 on the drive piston 26, the collet members 28 that have pivoted inward move back due to the resilience of the annular segments 29, and the catch pins 31 on the collet members 28 are introduced into the radial holes 47 of the drive piston 26. The lower end face of the drive piston 26 contacts the step faces 34 of the collet members 28. On the annular segments 29, the radial collet chuck 27 supports the free ends of the collet members 37 on the axial collet chuck 23. The axial collet chuck 23 abuts the drive piston 26 with its opposite axial end.

Figure 2:
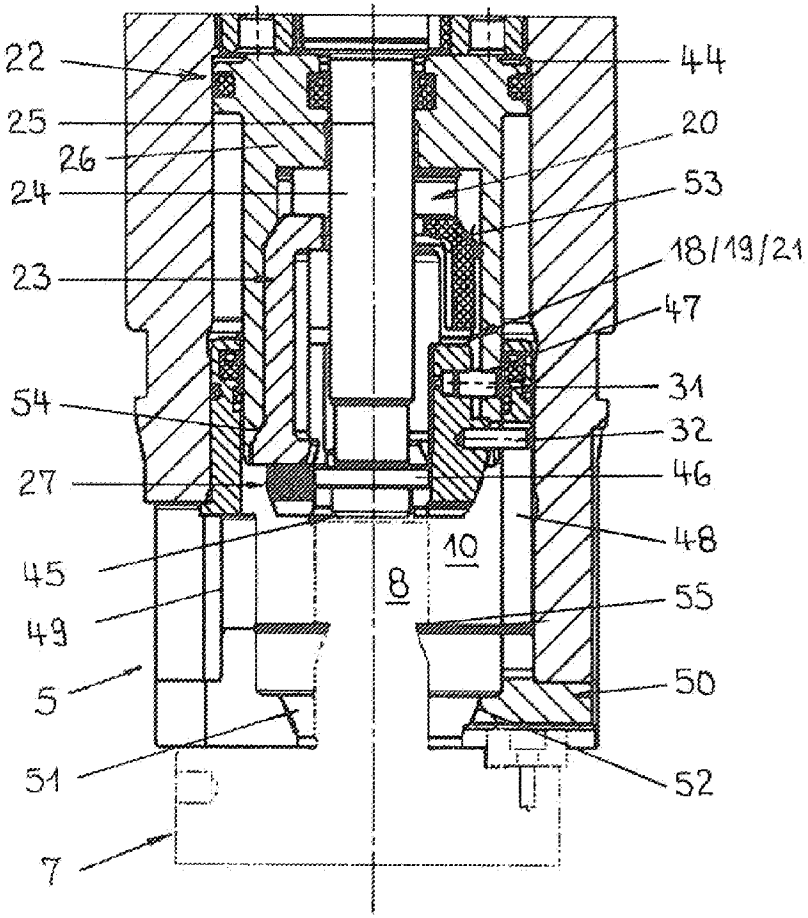
Figure 5:
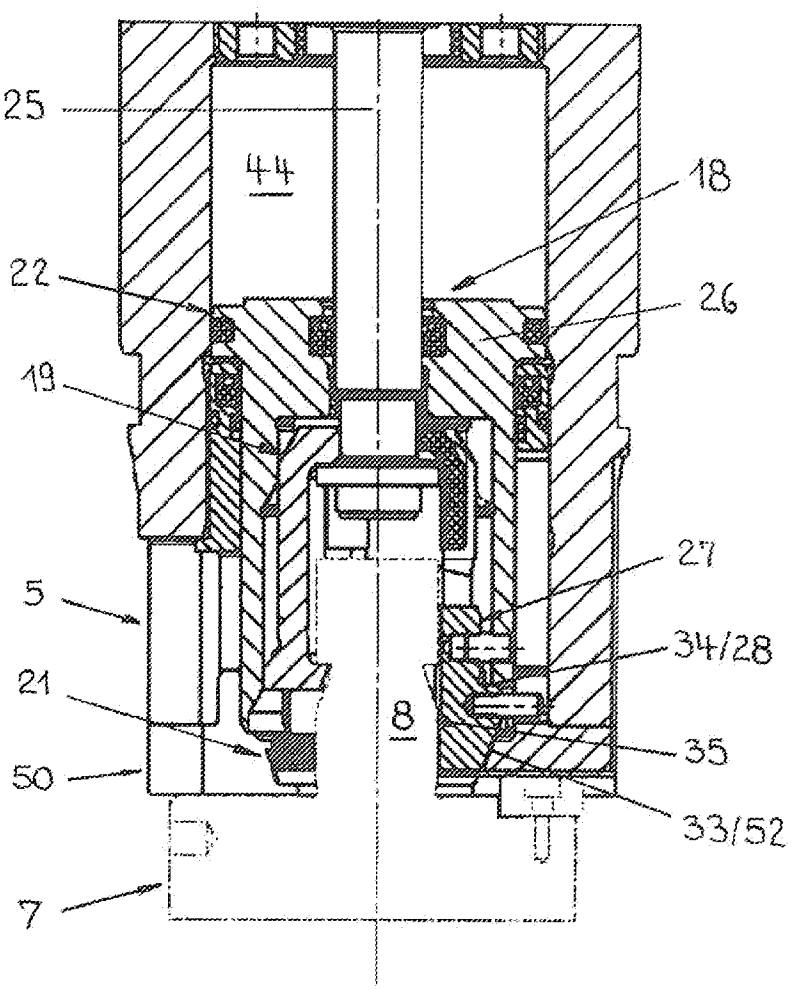

Referring particularly to FIG. 2, during assembly, the radial collet chuck 27 is oriented about the tensioning axis 25 in such a manner that the guide pin 32 on one of the collet members 28 of the radial collet chuck 27, when the radial collet chuck 27 is pushed into the drive piston 26, is introduced into a guide slot 48 that is along a laterally open sleeve 49 of the ram 5. A cover 50 that is also laterally open is then secured to the lower end of the ram 5.

The cover 50 has a central opening 51 that is formed by a conical-shaped wall. The conical-shaped wall of the cover 50 forms a wedge counter-face 52 that is associated with the wedge faces 33 of the radial collet chuck 27. The drive piston 26 is provided at the inner side thereof with an upper wedge counter-face 53 that is associated with the upper wedge face 40 of the axial collet chuck 23 and with a lower wedge counter-face 54 that is associated with the lower wedge face 41 of the axial collet chuck 23.

Still referring to FIG. 2, the configurations of the punching machine 1 at the ram 5 after the punch 7 has been laterally introduced into the tool receiving member 10 by the coordinate guide 15 is indicated by the dash-dotted lines. The shaft 8 of the punch 7 is secured to (e.g., located inside) the tool receiving member 10 and forms an undercut 55. The connection rod 24 is located at the lower end position thereof. The unit including the drive piston 26, the axial collet chuck 23, and radial collet chuck 27 is raised in the direction of the tensioning axis 25 such that the tool shaft 8 of the punch 7 can be laterally introduced into the tool receiving member 10. The radial clamping elements (e.g., the collet members 28) and the axial tensioning elements (e.g., the collet members 37) are located in respective rest positions.

The cylinder space 44 inside of the ram 5 is acted upon with a pressure medium (e.g., compressed air or a pressurized fluid). Consequently, the drive piston 26 moves together with the axial collet chuck 23 and the radial collet chuck 27 downward along the connection rod 24, which retains its position. The drive piston 26 is supported with the upper wedge counter-face 53 on the axial collet chuck 23. Accordingly, the drive piston 26 can carry the axial collet chuck 23 during downward movement. The drive piston 26 is coupled to the radial collet chuck 27 via the catch pins 31 and the radial holes 47.

Figure 3:
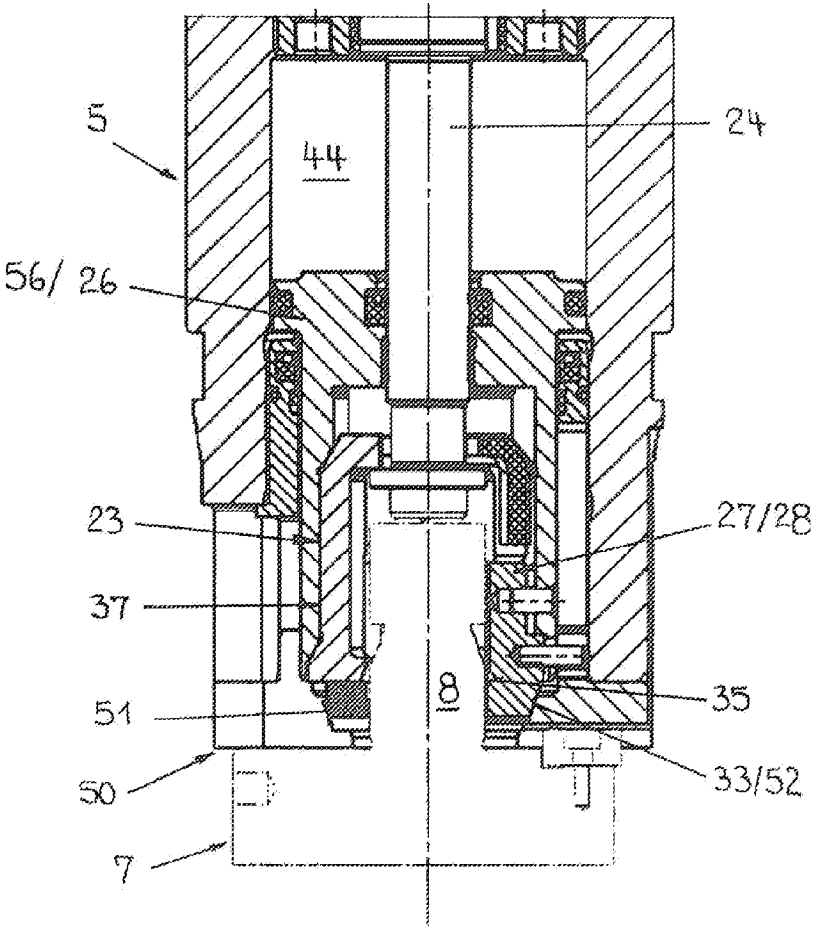
FIGS. 2-5 show cross-sectional views of the ram of FIG. 1 in various operational states and with a radial collet chuck and an axial collet chuck.

Referring to FIGS. 2 and 3, since the axial collet chuck 23 is provided with the axial tensioning elements (e.g., the collet members 37) and the radial collet chuck 27 is provided with the radial clamping elements (e.g., the collet members 28), the drive piston 26 acts as an element carrier for the collet members 28 and the collet members 37 of the tool tensioning and clamping device 18. Due to the downward movement of the drive piston 26, the collet members 28 and the collet members 37 are moved from rest positions associated with the tool changing operation as illustrated in FIG. 2 into positions of operational readiness as illustrated in FIG. 3. Consequently, the drive piston 26 forms part of a positioning drive 56 of a common positioning device of the axial tensioning device 19 and the radial clamping device 21.

While lowering the drive piston 26 from its position illustrated in FIG. 2 to its position illustrated in FIG. 3, the radial collet chuck 27 is introduced into the opening 51 of the cover 50 on the ram 5. The wedge faces 33 of the radial collet chuck 27 abut the wedge counter-face 52 of the cover 50.

The wedge faces 33 of the collet members 28 and the wedge counter-faces 52 of the cover 50 cooperate with each other in a manner similar to that in which wedge gear elements of a wedge gear cooperate with one another. Due to the interaction of the wedge faces 33 and the wedge counter-face 52, the collet members 28 abut the surface of the tool shaft 8 with the pressure faces 35, thereby applying a normal force thereto. The tool shaft 8 of the punch 7 is centered in the tool receiving member 10. Since the pressure in the cylinder space 44 is selected accordingly, the collet members 28 of the radial collet chuck 27 act on the tool shaft 8 with a force that allows an axial tensioning operation of the punch 7 via the connection rod 24.

In order to axially tension the punch 7, the connection rod 24 is moved by the connection rod drive (not illustrated in detail) in an upward direction along the tensioning axis 25 relative to the drive piston 26. The connection rod 24 carries the axial collet chuck 23 via the outer collar 46 of the retention screw 45. This results in a movement of the axial collet chuck 23 (which is decoupled from the drive piston 26) relative to the drive piston 26. The upper wedge faces 40 and the lower wedge faces 41 of the axial collet chuck 23 slide along the upper wedge counter-face 53 and the lower wedge counter-face 54 of the drive piston 26. The wedge faces and wedge counter-faces 40, 41, 53, 54 that cooperate with each other cause a radially inwardly directed pivotal movement of the collet members 37 of the axial collet chuck 23 in a manner that is similar to what occurs between drive motor-side and clamping element-side wedge gear elements of a wedge gear.

Figure 4:
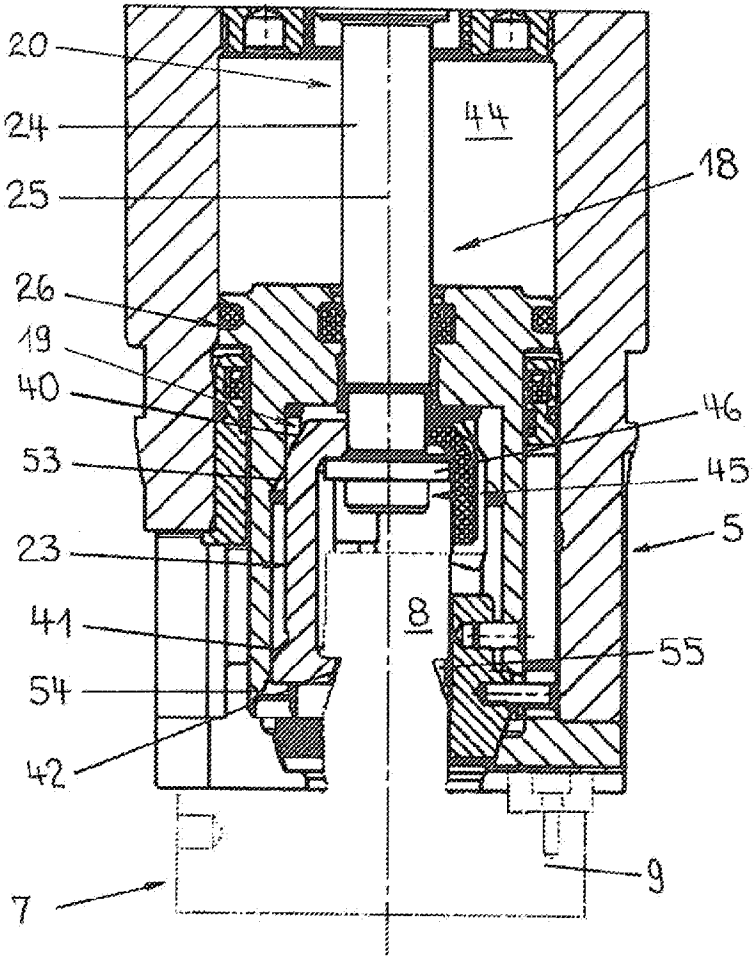

Referring to FIG. 4, due to the inward movement of the collet members 37, the hooks 42 at the ends of the collet members 37 engage the undercut 55 on the tool shaft 8 of the punch 7. Due to such positive-locking connection, the connection rod 24 carries the punch 7 during its upward movement. The adjustment ring 9 of the punch 7 abuts the lower end face of the ram 5 along the direction of the tensioning axis 25. With corresponding tensile force provided by the connection rod drive, the punch 7 is pulled against the adjustment ring 9 against the lower side of the ram 5, acting as an abutment in the direction of the tensioning axis 25 (see FIG. 4).

Continuing from the operational state shown in FIG. 4, the pressure in the cylinder space 44 increases. Consequently, the drive piston 26 moves and increasingly acts downward upon the radial collet chuck 27 at the step faces 34 of the collet members 28. As a result of the downward movement of the drive piston 26 and the action upon the collet members 28 and as a result of the cooperation of the wedge gear elements (i.e., the wedge faces 33 on the collet members 28 and the wedge counter-face 52 on the cover 50 of the ram 5), the collet members 28 apply an increased normal force via their pressure faces 35 upon the tool shaft 8 of the punch 7. The punch 7 is thereby clamped by the cover 50 via the collet members 28 of the radial collet chuck 27 in a direction that is perpendicular to the tensioning axis 25 of the axial tensioning device 19. The cover 50 acts as a ram-side abutment. The punch 7 is then secured to the ram 5.

In combination, the axial tensioning device 19 and the radial clamping device 21 provide dual-axis securing (e.g., fixing) of the punch 7 to the ram 5. Accordingly, an undesirable relative movement between the punch 7 and the tool receiving member 10 that can cause wear can be prevented, even in such cases of processing-related loading of the punch 7. The operations described above are controlled by CNC control of the punching machine 1.

A number of embodiments have been described. Nevertheless, it will be understood that various modifications may be made without departing from the spirit and scope of the disclosure. Accordingly, other embodiments are within the scope of the following claims.

What is claimed is:

1. A tool retention device for a machine tool, the tool retention device comprising:

a tool receiving member for at least partially receiving a processing tool of the machine tool;

a tool abutment;

an axial tensioning device having an axial tensioning element that is controllably transferable to a tensioning state, the processing tool being securable to the tool receiving member by the axial tensioning element when the processing tool has been received in the tool receiving member and the axial tensioning element has been transferred to the tensioning state, wherein the processing tool is pulled against the tool abutment along a direction of a tensioning axis of the axial tensioning device; and a radial clamping device having at least one radial clamping element that is controllably transferable to a clamping state while decoupled from the axial tensioning element of the axial tensioning device, the processing tool being securable to the tool receiving member by the radial clamping element when the processing tool has been received in the tool receiving member and the radial clamping element has been transferred to the clamping state, wherein the processing tool that is pulled against the tool abutment is clamped along a direction perpendicular to the tensioning axis of the axial tensioning device, wherein the axial tensioning device and the radial clamping device have a common positioning device, and wherein, via the common positioning device, the axial tensioning element and the radial clamping element are transferable together from a rest position into a position of operational readiness.

2. The tool retention device according to claim 1, wherein the machine tool is a punching machine.

3. The tool retention device according to claim 1, wherein the processing tool is a punching tool.

4. The tool retention device according to claim 1, wherein the common positioning device of the axial tensioning device and the radial clamping device has a positioning drive, wherein the positioning drive comprises a drive piston that allows the axial tensioning element and the radial clamping element to be moved together from the rest position into the position of operational readiness.

5. The tool retention device according to claim 4, wherein the drive piston of the positioning drive serves as an element carrier, on which the axial tensioning element and the radial clamping element are arranged together during movement from the rest position into the position of operational readiness.

6. The tool retention device according to claim 4, wherein the drive piston of the positioning drive serves as an element carrier, on which the axial tensioning element and the radial clamping element are arranged together during movement from the rest position into the position of operational readiness, wherein the radial clamping element is drivable via the drive piston of the positioning drive in order to move from the position of operational readiness into a clamping position that provides the clamping state, and wherein the axial tensioning element is decouplable from the drive piston of the positioning drive prior to the radial clamping element being moved from the position of operational readiness into the clamping position.

7. The tool retention device according to claim 4, wherein the axial tensioning device comprises a controlled axial tensioning drive and the radial clamping device comprises a controlled radial clamping drive, and wherein the controlled axial tensioning drive comprises a wedge gear including a wedge face provided on the axial tensioning element and a wedge counter-face provided on the drive piston of the positioning drive, and/or wherein the controlled radial clamping drive comprises a wedge gear including a wedge face provided on the radial clamping element and a counter wedge-face provided by a conical-shaped wall of a cover of the tool receiving member.

8. The tool retention device according to claim 1, wherein the axial tensioning device comprises a controlled axial tensioning drive and the radial clamping device comprises a controlled radial clamping drive, and wherein the axial tensioning element is movable via the controlled axial tensioning drive from the position of operational readiness into a tensioning position that provides the tensioning state and wherein the radial clamping element is movable via the controlled radial clamping drive from the position of operational readiness into a clamping position that provides the clamping state.

9. The tool retention device according to claim 1, wherein the radial clamping element comprises a pressure face configured to abut a surface of the processing tool that extends along the tensioning axis such that the radial clamping device can clamp the processing tool along the direction perpendicular to the tensioning axis, and wherein the processing tool that is pulled against the tool abutment is configured to be clamped via a clamping force that acts along the direction perpendicular to the tensioning axis and that is applied by the pressure face of the radial clamping element as the pressure face abuts the surface of the processing tool.

10. A machine tool having a tool retention device that comprises:

a tool receiving member for at least partially receiving a processing tool of the machine tool;

a tool abutment;

an axial tensioning device having an axial tensioning element that is controllably transferable to a tensioning state, the processing tool being securable to the tool receiving member by the axial tensioning element when the processing tool has been received in the tool receiving member and the axial tensioning element has been transferred to the tensioning state, wherein the processing tool is pulled against the tool abutment along a direction of a tensioning axis of the axial tensioning device; and a radial clamping device having at least one radial clamping element that is controllably transferable to a clamping state while decoupled from the axial tensioning element of the axial tensioning device, the processing tool being securable to the tool receiving member by the radial clamping element when the processing tool has been received in the tool receiving member and the radial clamping element has been transferred to the clamping state, wherein the processing tool that is pulled against the tool abutment is clamped along a direction perpendicular to the tensioning axis of the axial tensioning device, wherein the axial tensioning device and the radial clamping device have a common positioning device, and wherein, via the common positioning device, the axial tensioning element and the radial clamping element are transferrable together from a rest position into a position of operational readiness.

11. The machine tool according to claim 10, wherein the machine tool comprises a punching machine.

* * * * *